US007510137B2

(12) United States Patent
Tramontina et al.

(10) Patent No.: US 7,510,137 B2
(45) Date of Patent: Mar. 31, 2009

(54) DISPENSER FOR SHEET MATERIAL

(75) Inventors: Paul Francis Tramontina, Harleysville, PA (US); Gerald L. Clark, Nicholson, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 15 days.

(21) Appl. No.: 11/753,016

(22) Filed: May 24, 2007

(65) Prior Publication Data

US 2008/0290210 A1 Nov. 27, 2008

(51) Int. Cl.
*B65H 49/38* (2006.01)

(52) U.S. Cl. ..... 242/593; 242/615.3; 206/409; 220/253

(58) Field of Classification Search ..... 242/593, 242/132, 137, 615.3, 615.4, 146; 206/409, 206/390, 394, 205, 210, 812; 220/253; 221/1, 221/62, 63

See application file for complete search history.

(56) References Cited

U.S. PATENT DOCUMENTS

| | | | |
|---|---|---|---|
| 3,523,653 | A | 8/1970 | Hansen |
| 3,627,216 | A | 12/1971 | Ekuan |
| 3,726,395 | A | 4/1973 | Duhy |
| 3,923,223 | A | 12/1975 | Larsson et al. |
| 4,096,311 | A | 6/1978 | Pietreniak |
| 4,180,160 | A | 12/1979 | Ogawa et al. |
| 4,262,816 | A | 4/1981 | Margulies |
| 4,289,262 | A | 9/1981 | Finkelstein |
| 4,460,106 | A | 7/1984 | Moulding, Jr. et al. |
| 4,524,895 | A | 6/1985 | Lunden |
| 4,534,491 | A | 8/1985 | Norton et al. |
| 4,579,266 | A | 4/1986 | Bünger et al. |
| D285,995 | S | 10/1986 | Minost |
| 4,615,937 | A | 10/1986 | Bouchette |
| 4,692,374 | A | 9/1987 | Bouchette |
| D296,765 | S | 7/1988 | Urion |
| 4,756,460 | A | 7/1988 | Ornros |
| 4,760,970 | A | 8/1988 | Larsson et al. |
| 4,818,594 | A | 4/1989 | Albien et al. |
| 4,846,415 | A | 7/1989 | Jernberg et al. |
| 4,847,089 | A | 7/1989 | Kramer et al. |
| 4,905,868 | A | 3/1990 | Beane et al. |

(Continued)

FOREIGN PATENT DOCUMENTS

| | | |
|---|---|---|
| DE | 2818757 | 11/1979 |

(Continued)

OTHER PUBLICATIONS

American Society of Testing Materials (ASTM) Designation: D3776-96, "Standard Test Methods for Mass Per Unit Area (Weight) of Fabric," published Jun. 1996, pp. 86-89.

(Continued)

*Primary Examiner*—William A Rivera
(74) *Attorney, Agent, or Firm*—Nathan P. Hendon

(57) ABSTRACT

A dispenser adapted to vertically dispense sheet material therefrom is provided. The dispenser includes a housing, configured to support a sheet material product therein, a platform with an opening, and an exit plate. The exit plate is adapted to reposition when the sheet material is dispensed by the user at a deflection angle relative to the vertical dispensing axis of the dispenser.

20 Claims, 15 Drawing Sheets

U.S. PATENT DOCUMENTS 4,929,498 A 5/1990 Suskind et al.
4,941,989 A 7/1990 Kramer et al.
4,946,617 A 8/1990 Sheridan et al.
4,979,617 A 12/1990 Benoit
5,004,760 A 4/1991 Patton et al.
5,006,267 A 4/1991 Vaughn et al.
5,059,629 A 10/1991 Patton et al.
5,061,395 A 10/1991 Meng
5,065,924 A 11/1991 Granger
5,091,102 A 2/1992 Sheridan
5,094,770 A 3/1992 Sheridan et al.
5,131,561 A 7/1992 Casperson et al.
5,141,171 A 8/1992 Yang
5,151,321 A 9/1992 Reeves et al.
5,205,455 A 4/1993 Moody
5,211,308 A 5/1993 Decker et al.
5,215,211 A 6/1993 Eberle
5,219,126 A 6/1993 Schutz
D337,464 S 7/1993 Giugiaro
D339,014 S 9/1993 Giugiaro
D339,015 S 9/1993 Giugiaro
5,246,137 A 9/1993 Schutz et al.
5,263,607 A 11/1993 Temesvary et al.
5,273,184 A 12/1993 Rizzuto
5,310,083 A 5/1994 Rizzuto
5,346,064 A 9/1994 Rizzuto
5,366,732 A 11/1994 Zighelboim
5,370,338 A 12/1994 Lewis
5,421,898 A 6/1995 Cavanagh
5,438,034 A 8/1995 Walker
5,480,060 A 1/1996 Blythe
5,523,487 A 6/1996 Walker
5,560,514 A 10/1996 Frazier
5,577,634 A 11/1996 Morand
5,577,635 A 11/1996 Block
5,582,362 A 12/1996 Johnson et al.
5,620,527 A 4/1997 Kramer et al.
D385,734 S 11/1997 Mervar et al.
5,715,971 A 2/1998 Morand
5,749,492 A 5/1998 Petterson
5,762,286 A 6/1998 Schutz
5,762,287 A 6/1998 Schutz
5,765,718 A 6/1998 Grasso et al.
5,769,354 A 6/1998 Lindh et al.
D396,369 S 7/1998 Giugiaro
5,785,274 A 7/1998 Johnson
5,833,741 A 11/1998 Walker
D403,543 S 1/1999 Grasso et al.
5,855,817 A 1/1999 Walker
5,857,642 A 1/1999 Zinnbauer
5,868,346 A 2/1999 Cobos
5,908,854 A 6/1999 McCue et al.
5,929,016 A 7/1999 Harrison
5,981,668 A 11/1999 Fujita et al.
6,017,561 A 1/2000 Zhou et al.
6,017,869 A 1/2000 Lu et al.
6,022,841 A 2/2000 Lu et al.
6,062,422 A 5/2000 Ellis
6,080,789 A 6/2000 Lutz
6,082,663 A 7/2000 Tramontina et al.
6,089,499 A 7/2000 Robinson
6,090,771 A 7/2000 Burt et al.
6,090,855 A 7/2000 Walker
6,129,240 A 10/2000 Morand
6,143,710 A 11/2000 Lu et al.
6,145,782 A 11/2000 King et al.
6,182,858 B1 2/2001 Hartog
6,189,726 B1 2/2001 Fick
6,267,321 B1 7/2001 Tramontina
6,268,327 B1 7/2001 Lu et al.
6,270,754 B1 8/2001 Zhou et al.
D449,474 S 10/2001 Conran et al.
6,297,285 B1 10/2001 Lutz
6,313,049 B1 11/2001 Heady et al.
6,328,252 B1 12/2001 Neveu et al.
6,340,663 B1 1/2002 Deleo et al.
6,346,125 B1 2/2002 Mao
6,354,426 B1 3/2002 Habisreitinger et al.
6,387,871 B2 5/2002 Faber
6,489,285 B2 12/2002 Faber
6,559,116 B1 5/2003 Godfroid et al.
6,575,397 B1 6/2003 Tramontina et al.
6,629,667 B2 10/2003 Tramontina
6,667,289 B2 12/2003 Harrison et al.
6,667,290 B2 12/2003 Svendsen
6,673,761 B2 1/2004 Mitra et al.
6,693,070 B1 2/2004 Cheung et al.
6,703,033 B2 3/2004 Smadi et al.
D488,655 S 4/2004 Tramontina et al.
6,716,805 B1 4/2004 Sherry et al.
6,734,157 B2 5/2004 Radwanski et al.
6,794,352 B2 9/2004 Svendsen
6,825,158 B2 11/2004 Mitra et al.
6,841,090 B1 1/2005 Serego Allighieri et al.
6,841,527 B2 1/2005 Mitra et al.
6,869,041 B1 3/2005 Allegre et al.
6,916,776 B2 7/2005 Svendsen
6,936,580 B2 8/2005 Sherry et al.
6,951,834 B2 10/2005 Mitra et al.
7,040,568 B2 5/2006 Lewis et al.
7,131,609 B1 * 11/2006 Lewis et al. ..... 242/593
2002/0031966 A1 3/2002 Tomarchio et al.
2002/0183223 A1 12/2002 Hokkirigawa et al.
2003/0100465 A1 5/2003 Kilkenny et al.
2003/0109411 A1 6/2003 Kilkenny et al.
2003/0194932 A1 10/2003 Clark et al.
2003/0216273 A1 11/2003 Mitra et al.
2004/0041312 A1 3/2004 Connors, Sr.
2004/0137815 A1 7/2004 Ellis et al.
2004/0209792 A1 10/2004 Mitra et al.
2004/0228904 A1 11/2004 Ellis et al.
2005/0034255 A1 2/2005 Svendsen
2005/0153857 A1 7/2005 Sherry et al.
2006/0009369 A1 1/2006 Kilkenny et al.
2006/0166849 A1 7/2006 Kilkenny et al.

FOREIGN PATENT DOCUMENTS

DE 2222357 6/1980
EP 0107487 A1 5/1984
EP 0117567 A1 9/1984
EP 0128127 A2 12/1984
EP 0091411 B1 12/1985
EP 0061248 B1 11/1986
EP 0068722 B1 4/1988
EP 0238460 B1 8/1990
EP 0231183 B1 1/1991
EP 0550863 A1 7/1993
EP 0480848 B1 1/1994
EP 0642317 B1 2/1997
EP 0595779 B1 4/2000
EP 0740921 B1 9/2000
EP 1066787 B1 3/2005
FR 2667853 4/1992
FR 2667854 4/1992
FR 2668694 5/1992
FR 2669818 6/1992
GB 1455216 11/1976
GB 2038778 7/1980
GB 2063213 6/1981
GB 2120639 12/1983
GB 2145693 9/1986
GB 2270299 3/1994
WO WO 93/22963 11/1993

| | | |
|---|---|---|
| WO | WO 93/22964 | 11/1993 |
| WO | WO 97/21377 | 6/1997 |
| WO | WO 03/053144 | 7/2003 |

OTHER PUBLICATIONS

American Society for Testing Materials (ASTM) Designation: D5035-95, "Standard Test Method For Breaking Force and Elongation of Textile Fabrics (Strip Method)," published Jul. 1995, pp. 682-688.

TAPPI Official Test Method T411 om-89, "Thickness (Caliper) of Paper, Paperboard, and Combined Board," published by the TAPPI Press, Atlanta, Georgia, revised 1989, pp. 1-3.

* cited by examiner

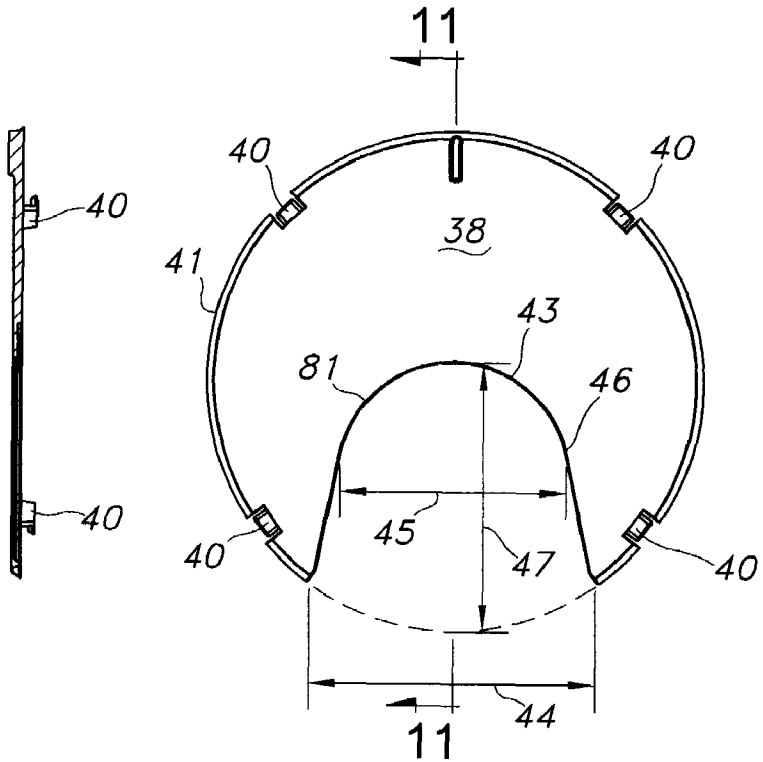
FIG. 10
FIG. 11
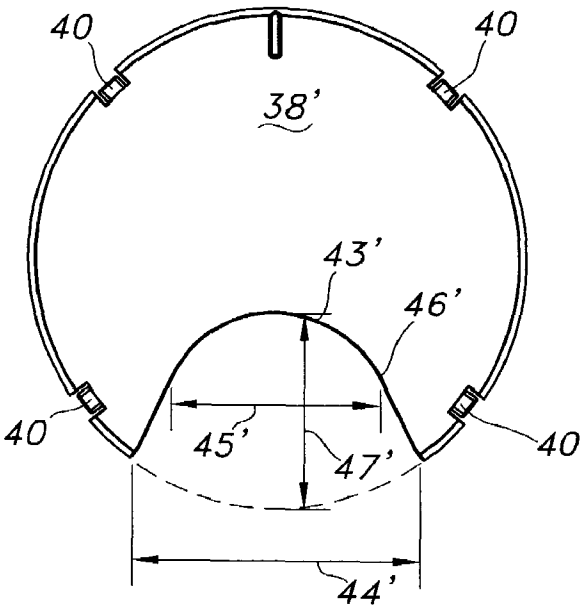
FIG. 12

DISPENSER FOR SHEET MATERIAL

BACKGROUND

Dispensers for rolls or stacks of sheet material have an exit port, which usually permits one sheet material at a time to be dispensed therethrough. One typical type of sheet material dispenser is mounted such that the towel is dispensed from the underside of the dispenser. This type of dispenser is most commonly associated with the dispensing of centerflow rolled towel products in which the rolled product is dispensed from an orifice on the underside of the dispenser. Such dispensers commonly have problems with proper dispensing of such rolled product. Often too much product will dispense, as it fails to tear off in the dispenser, or the product will prematurely tear off, leaving the user with a small tab of a towel. Either of such results are considered dispensing failures.

Some have tried to improve such dispensers by various features and methods. For example, the dispensers taught in U.S. Pat. No. 5,765,718 to Grasso et al. and U.S. Pat. No. 6,869,041 to Allegre et al. each utilize a conical chute to feed the tail of the towel roll toward a constricted dispensing orifice. Such a constricted orifice is designed to cause the sheet material to tear at prescribed perforations in the sheet while not restricting the flow such to cause premature tearing before such perforations. Additionally, the dispenser of Allegre et al. utilizes a biasing member to press the sheet material against the dispensing opening with an amount of force applied to the sheet material to retain the tail in the opening and cause the sheet material to separate at the prescribed perforations in the sheet.

In U.S. Pat. No. 6,629,667 to Tramontina, another type of centerflow roll dispenser is disclosed. That patent includes one of the inventors of the present invention and is similarly assigned. In one of the dispensers disclosed by the Tramontina, the sheet material passes through a Z-shaped path, which causes the sheet material to separate as desired, without the use of a constricted opening.

One issue present with all such centerflow vertical dispensers is that such dispensers are designed to dispense best when the sheet material is pulled straight downward, along a vertical axis extending down from the dispensing opening. However, users of such dispensers often naturally dispense the sheet material at some deflection angle relative to the vertical dispensing axis. A user will often pull the towel towards themselves or will pull the towel across the dispenser as they walk past the dispenser. In either case, the user pulls at some deflection angle from the preferred vertical dispensing. Typically, the sheet material will improperly dispense, or fail to dispense, the greater the deflection angle at which the user attempts to dispense. The inventors have found that is not uncommon for a typical centerflow dispenser to fail to dispense only 5 to 8 percent of the time when a user properly dispenses with a vertical pull. However, when the user pulls on the same sheet material at an angle of 45 degrees from vertical, the rate of failures can increase upward to around 50 percent. If the angle of pull increases to around 60 degrees from vertical, typical centerflow dispensers will fail to dispense the centerflow sheet material 85 to 100 percent of dispensing attempts.

Definitions

As used herein, the term "caliper" refers to the thickness measurement of a sheet taken under constant force. The caliper may be determined using test method number TAPPI 411-OM-89.

As used herein, the term "basis weight" (hereinafter "BW") is the weight per unit area of a sample and may be reported as gram-force per meter squared and may be hereinafter calculated using test procedure ASTM D3776-96.

As used herein, the term "machine direction" (hereinafter "MD") is the direction of a material parallel to its forward direction during processing.

As used herein, the term "machine direction tensile" (hereinafter MDT) is the breaking force in the machine direction required to rupture a specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf".

As used herein, the term "exit port" or "dispensing port" is the opening in a housing of a dispenser for the passage of sheet material out of the dispenser.

As used herein, the term "centerflow roll" or "centerflow roll product" means sheet material wound cylindrically about a center, but permitting the removal of material from the center. Desirably, as the centerflow roll is consumed, sheet material eventually dispenses from the roll's periphery. Dispensing of centerflow roll products are described in numerous patents, such as, but not by way of limitation, U.S. Pat. No. 5,370,338 to Lewis and U.S. Pat. No. 6,082,663 to Tramontina et al.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymer, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "couple" includes, but is not limited to, joining, connecting, fastening, linking, or associating two things integrally or interstitially together. As used herein, the term "releaseably connect(ed)" refers to two or more things that are stably coupled together and are at the same time capable of being manipulated to uncouple the things from each another.

As used herein, the term "configure" or "configuration" means to design, arrange, set up, or shape with a view to specific applications or uses. For example: a military vehicle that was configured for rough terrain; configured the computer by setting the system's parameters.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As used herein, the terms "orientation" or "position" used interchangeably herein refer to the spatial property of a place where or way in which something is situated; for example, "the position of the hands on the clock."

As used herein, the term "consumer" refers to a person (or persons) who may be responsible for selecting, purchasing, providing, installing, maintaining, refilling, configuring, and/or other similar administrative functions related to the system, its components, and/or the products dispensed from such a system. As used herein, the term "user" refers to person who may use the system and/or the products dispensed from such a system.

SUMMARY OF THE INVENTION

In light of the problems discussed above, a need exists for a vertical dispensing dispenser that is capable of dispensing sheet material along the vertical dispensing axis, but also improves the successful dispensing of such materials when the user attempts to dispense the sheet material at a deflection angle from the desired vertical dispensing axis.

The present invention is directed to a dispenser adapted to dispense sheet material in a generally vertical direction. The dispenser includes a housing having a platform, an exit plate, and a vertical dispensing axis. The platform is configured to support sheet and includes an opening positioned on a first axis. The exit plate is spaced apart from the platform and includes an exit port positioned on a second axis. The second axis is parallel to and spaced apart from the first axis. The sheet material passes through the dispenser, moving from the opening and the exit port, along a third axis. The exit plate is adapted to reposition when sheet material applies force on the exit plate as the sheet material is dispensed by the user at an angle of deflection, relative to the vertical dispensing axis.

The invention is also directed to a dispenser adapted to dispense sheet material and includes a housing having an orifice plate, an exit plate, an exit port, and a vertical dispensing axis. The orifice plate includes an opening positioned on the orifice plate and the exit plate is spaced apart from the orifice plate. The sheet material flows through the dispenser between the opening and the exit port in a generally Z-shaped path. Finally, the exit plate is adapted to reposition when sheet material applies force on the exit plate as the sheet material is dispensed at an angle of deflection, relative to vertical dispensing axis.

Finally, the invention is also directed to a dispenser adapted to dispense sheet material including a housing having a platform, a dispensing port, and a vertical dispensing axis. The dispenser also includes a means for controlling the movement of sheet material disposed in the housing through the dispensing port and reconfiguring the dispensing port to accommodate dispensing of sheet material at an angle of deflection relative to the vertical dispensing axis. The controlling means comprises an opening positioned on a first axis and a moveable exit port positioned on a second axis.

BRIEF DESCRIPTION OF THE DRAWINGS

FIG. 10 is a top plan view of one embodiment of the upper orifice plate;

FIG. 11 is a sectional view of FIG. 10 taken along lines 11-11;

FIG. 12 is a top plan view of another embodiment of an upper orifice plate;

DETAILED DESCRIPTION

Figure 1:
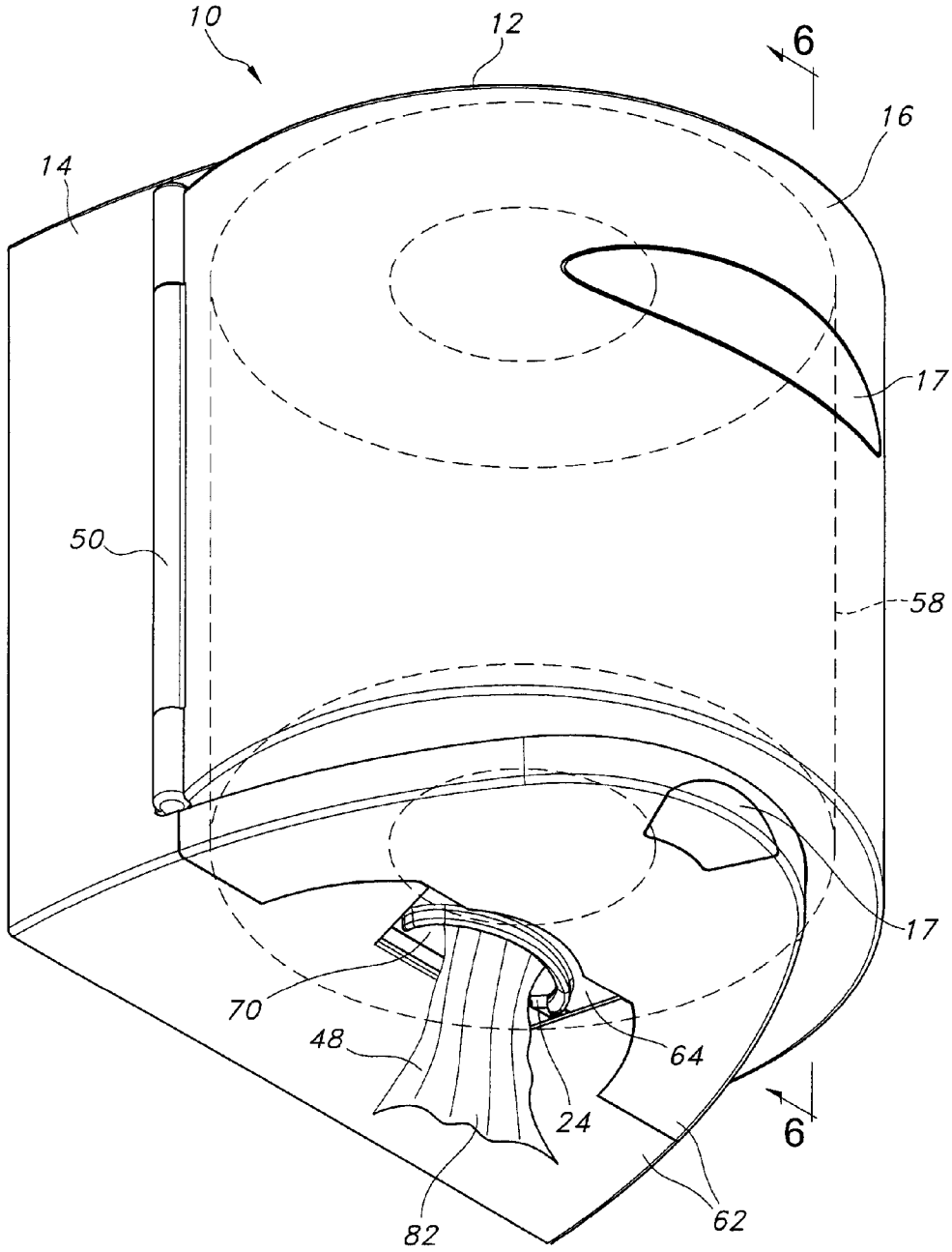
FIG. 1 is a perspective view of a dispenser for sheet material from the lower end of the dispenser, showing a roll of centerflow sheet material disposed in the dispenser (illustrated by phantom lines) and sheet material extending from an exit port.
Figure 2:
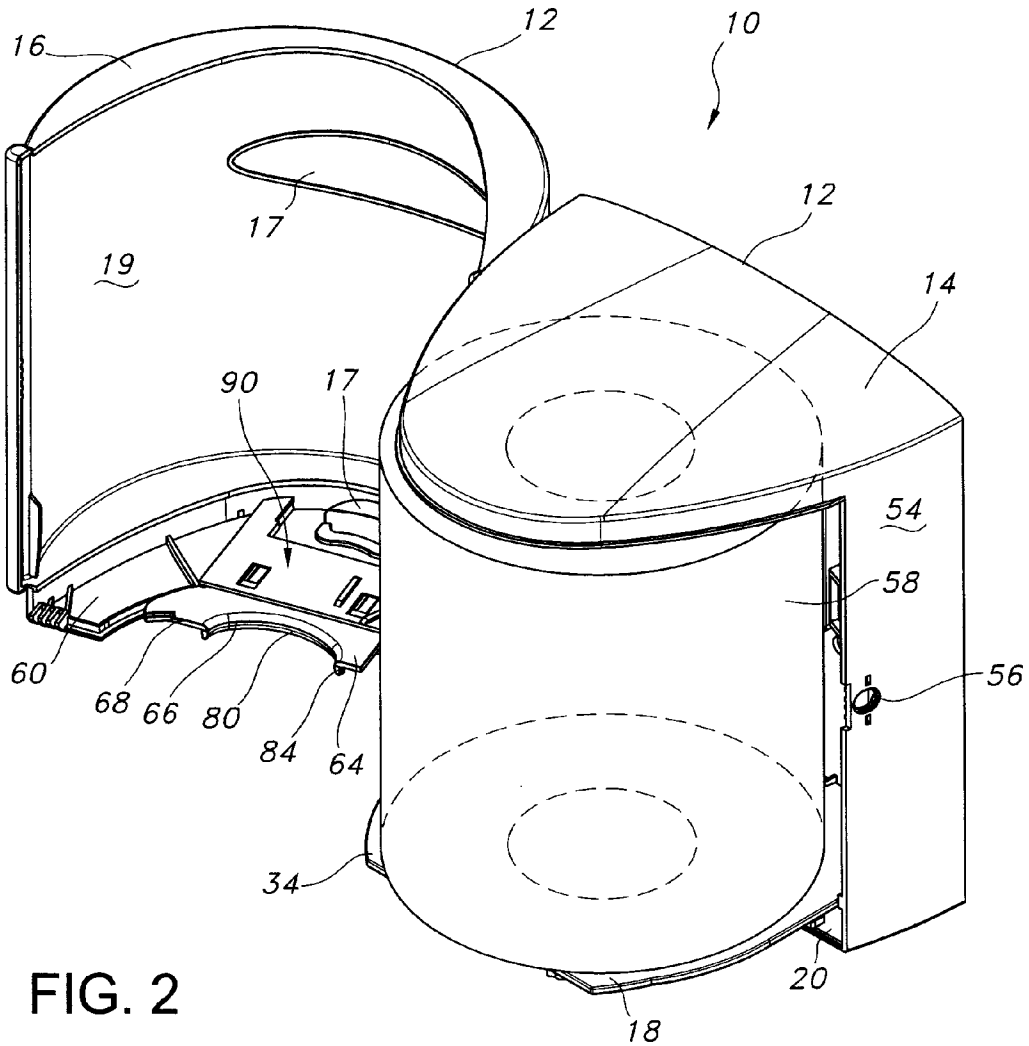
FIG. 2 is an perspective view of the dispenser of FIG. 1, showing the dispenser opened and a roll of centerflow sheet material disposed therein.
Figure 3:
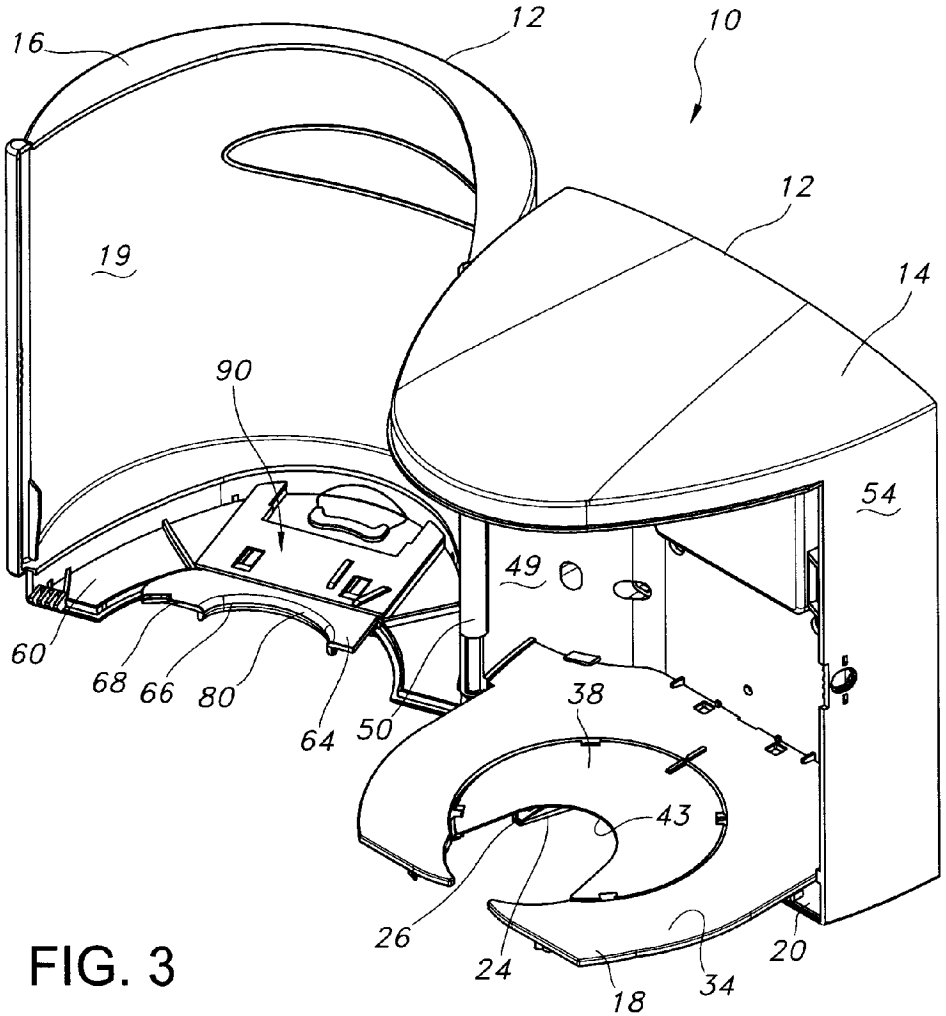
FIG. 3 is an perspective view similar to FIG. 2, but showing the dispenser housing when the roll of centerflow sheet material is removed.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure may be used on another embodiment or figure to yield yet another embodiment. It is intended that the present invention include such modifications and variations.

Illustrated in FIGS. 1 to 9 and 14 to 17 is a dispenser 10 for sheet material. The dispenser 10 includes a dispenser housing 12. The dispenser housing 12 includes a roll housing 14 and a cover 16.

Figure 4:
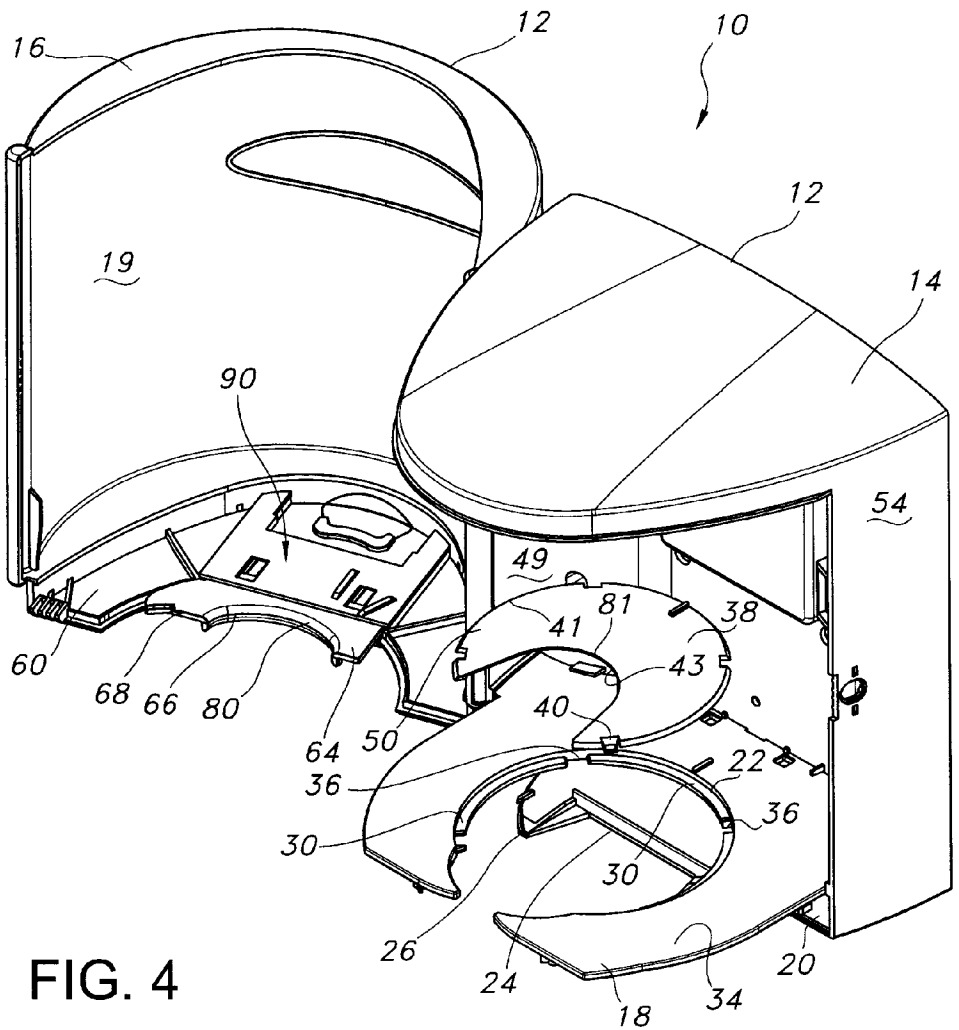
FIG. 4 is a partial exploded view of the roll platform of the dispenser of FIG. 3, showing a moveable upper orifice plate.
Figure 14:
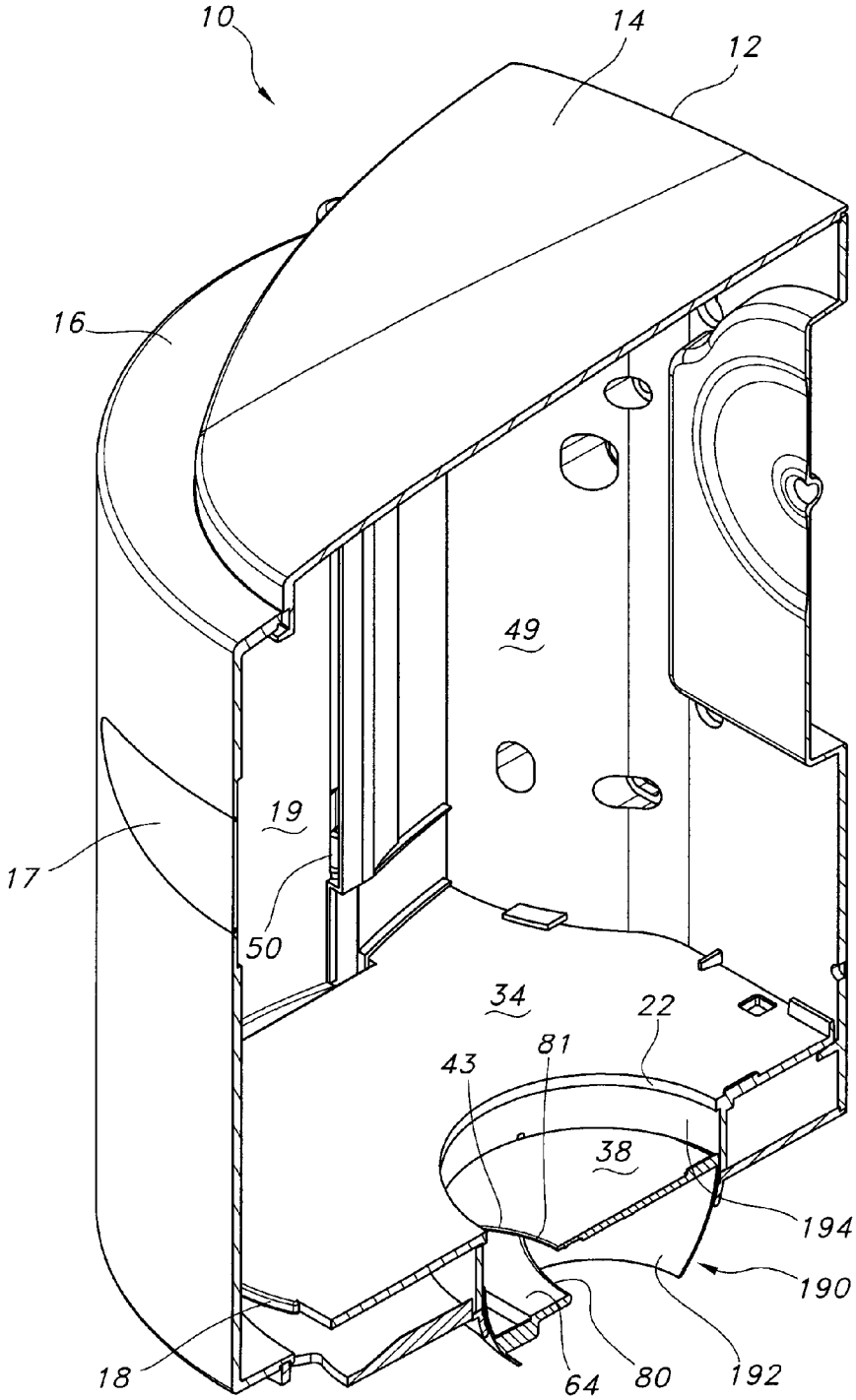
FIG. 14 is a cross-sectional perspective view of the dispenser of FIG. 13 and illustrating the dynamic exit plate assembly in a neutral dispensing configuration.

The roll housing 14 is configured to permit attachment of the dispenser 10 to a wall or suitable surface (not shown). The roll housing 14 includes a roll platform 18 which is positioned near a lower end 20 of the roll housing 14. As illustrated in FIGS. 4 and 14, the roll platform 18 includes a slot or opening 22. Another slot 24 is positioned on a front edge 26 of the lower end 20 of the roll housing 14. The roll platform 18 and the lower end 20 are spaced a distance 28 apart (see FIGS. 8 and 15).

The cover 16, as illustrated in FIGS. 1-7, 13, 14 and 17, is coupled to one side 49 of the roll housing 14 via a vertical hinge 50 that is secured to both a portion of the side 49 and a portion of the cover 16. The hinge 50 permits the cover 16 to pivot away from the roll housing 14, to permit complete access to the roll housing 14 and roll platform 18. While a hinge is used in the present embodiment, other fastening means may be used. A fastener means 56 is positioned on an opposite side 54 of the roll housing 14 and the cover, respectively, to secure the cover 16 in a closed position.

The cover 16 may be formed from an opaque material, or alternatively, the cover 16, or any portion thereof, may be formed from a clear, tinted, or translucent material, so that a reduction in the centerflow roll 58 disposed in the dispenser 10 may be seen by an operator. For example, the dispenser 10 illustrated in FIGS. 1-7, 13, 14, and 17, includes windows 17 through which an operator may view the amount of sheet material remaining to be dispensed. The cover 16 is rounded, to at least partially follow the curvature of the centerflow roll 58 of sheet material 48 positioned therein, although other shapes may be used.

The cover 16 has a lower end portion 60, which together with the lower end 20 of the roll platform 14, forms a lower end 62 of the dispenser housing 12. As illustrated in FIGS. 2, 3, 4, 13, 14, and 17, a dynamic exit plate assembly 90, 190, 290, including a dynamic exit plate 64, is associated with the lower end portion 60.

The dispensing of the sheet material 48 is accomplished through a circuitous path between the centerflow roll 58 resting on the platform 18 of the roll housing 14, past an upper orifice plate 38, past a dynamic exit plate 64, and through the exit port 70. The upper orifice plate 38 is oriented above and spaced apart from the dynamic exit plate 64 by a distance 28. Additionally, the upper orifice plate 38 and the dynamic exit plate 64 each include an opening or slot 43, 66 through which the sheet material 48 passes, along the sheet material dispensing path 77. The sheet material 48 is allowed to freely flow between the slots 43, 66 of the upper orifice plate 38 and the dynamic exit plate 64 without any chute, funnel, or other structure to constrict the flow of the sheet material 48.

Figure 15:
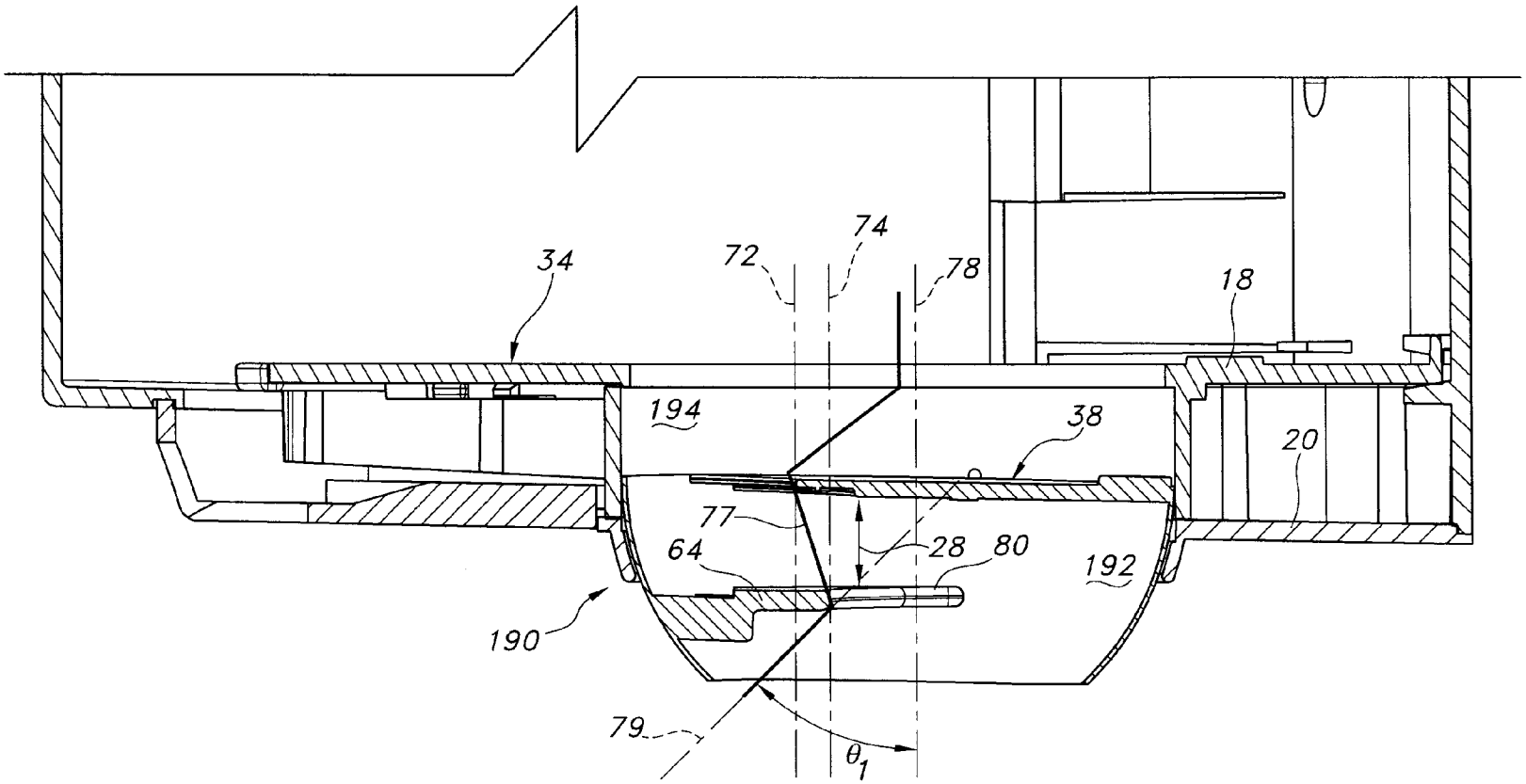
FIG. 15 is a partial, cross-sectional view of the lower portion of the dispenser of FIG. 13 and illustrating the dynamic exit plate assembly in a neutral dispensing configuration.
Figure 16:
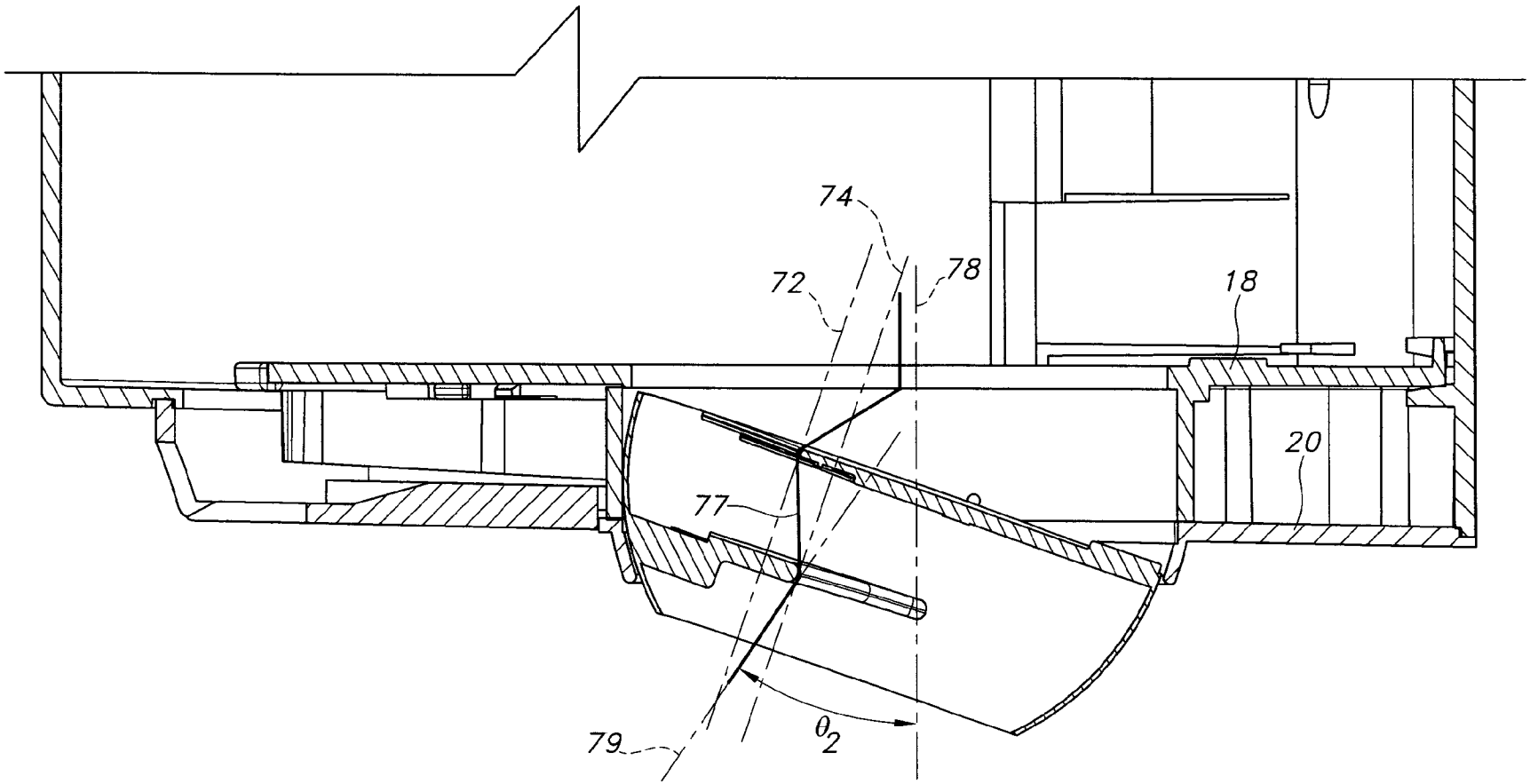
FIG. 16 is a partial, cross-sectional view, similar to FIG. 15, of the lower portion of the dispenser of FIG. 1 and illustrating the dynamic exit plate assembly in a fully-engaged configuration.

The upper orifice plate 38 is oriented closer to the roll platform 18 and the centerflow roll 58, while the dynamic exit plate 64 is oriented closer to the exit port 70 of the dispenser 10. The upper orifice plate 38 may be in substantially the same plane as the roll platform 18, such as shown in FIGS. 3, 6, 7, 8, 9, and 17, or may be in a different plane, such as shown in FIGS. 14, 15 and 16. Similarly, the dynamic exit plate 64 may be in substantially the same plane as the lower end 20 of the roll housing 14, such as shown in FIGS. 6-9, or may be in a different plane, such as shown in FIGS. 13-17.

Additionally, the upper orifice plate 38 may be adapted to be removable, may be an integral part of the dispenser housing 12, or may be an integral part of the dynamic exit plate assembly 190, 290. To accommodate such a removable upper orifice plate 38, the roll housing 14 may be adapted similarly to the exemplary configuration illustrated in FIGS. 3, 4, and 6-12. The exemplary upper orifice plate 38 illustrated in FIGS. 3, 4, and 6-12 is shown as being circular, although other shapes may be used. In this exemplary configuration, the roll platform 18 of the roll housing 14 includes a flange member 30 formed along a periphery 32 of the opening 22 and slightly recessed from an upper surface 34 of the roll platform 18. The flange member 30 includes a plurality of spaced-apart slots 36. An upper orifice plate 38 is positioned to lie upon the flange member 30. The upper orifice plate 38 is then configured to be positioned on the flange member 30 and to conform to a substantial portion of the periphery 32 of the opening 22 of the roll platform 18. The upper orifice plate 38 includes a plurality of tabs 40 positioned about its periphery 41. Each tab 40 is positioned to pass through one slot 36 and extend below the flange member 30. When the upper orifice plate 38 is positioned accordingly and rotated slightly, the tabs 40 slide past the slots 36 and are positioned against a lower surface 42 of the flange member 30 to hold the upper orifice plate 34 in a position for dispensing, as shown in FIGS. 3, 6, 7, 8 and 9.

Whether it is removable or non-removable, the upper orifice plate 38 includes a concave curved slot 43 formed in the periphery 41 thereof, which forms a widened generally U-shape, as illustrated in FIGS. 3, 4, 10, 12, 13 and 17. That is, each side of the U-shape is a greater distance 44 apart at the top of the widened U-shape, and a lesser distance 45 apart at the lower rounded end 46 of the U-shape.

The depth 47 of the U-shaped slot 43, as well as the width of the U-shape, is dictated by the product-type of sheet material 48 positioned in the dispenser 10. For example, a comparison of the upper orifice plate 38 illustrated in FIG. 10 with an alternative upper orifice plate 38' shown in FIG. 12 illustrates the widths 44, 44' of the upper orifice plates 38, 38', respectively are approximately equal, but the depth, 47' of upper orifice plate 38' is greater than is the depth 47 of upper orifice plate 38. The greater depth 47' of the slot 43' of upper orifice plate 38' causes less frictional resistance, and is used with thicker, i.e., greater basis weight, sheet material products. Thinner, i.e., lesser basis weight products, require a lesser depth 47 of the slot 43 of the orifice face 38. In use, the slot 43 is in alignment with the opening 22 in the roll platform 18, to permit easy threading of sheet material 48 therethrough.

In this manner, the design of the slot 43 of the upper orifice plate 38 may be designed appropriately for the product to be dispensed. In embodiments where the upper orifice plate 38 is removable, providing only a few different upper orifice plates 38, 38' would allow for proper dispensing of a number of different product types. It will be appreciated that in an alternative embodiment, an additional upper orifice plate(s) may be stored in the roll housing 14 (not shown).

The dynamic exit plate 64 also has a concave curved slot 66 formed in a perimeter 68 of the dynamic exit plate 64. The curved slot 66 is illustrated as a semi-elliptical shape, although a semi-circular or other shapes may be used. The slot 66 of the dynamic exit plate may be designed with the same considerations as discussed above for the slot 43 of the upper orifice plate 38.

In addition to the upper orifice plate 38 being curved in shape, the slot edge 81 of the upper orifice plate 38 may be rounded on its thickness such that the sheet material 48 that passes over the edge 81 of the plate 38 will contact a rounded edge 81, rather than a sharp corner. Similarly, the slot edge 80 of the dynamic exit plate 64 may be rounded. Additional curvature may be added to the slot edge 80 with the inclusion of a curved lip 84. Such a lip 84, as illustrated in FIGS. 2 and 5-9, allows the sheet material 48 to pass along a greater surface area than would be presented by a non-rounded corner or a simple rounded edge. When present, the lip 84 is desirably an integral part of the plate 64, but it may be a separate piece that is attached to the edge 80 of the plate 64.

When the cover 16 of the dispenser 10 is closed, the lower end 20 of the roll housing 14 and the lower end portion 60 of the cover 16 are brought together to provide the closed dispensing position, as illustrated in FIGS. 1, 6, 7, 8 and 9. In the closed dispensing position, the dynamic exit plate 64 moves into a cooperative position with the slot 24 in the roll housing 14 to provide an exit port 70. In this instance, the exit port 70 includes one curved side (formed by the curved edge 80 of the dynamic exit plate 64), and one straight side (formed by the opening 24 in the lower end 20 of the roll housing 14), but other configurations are possible. In use, the sheet material 48 from the centerflow roll 58 positioned on the roll platform 18 flows through the slot 43 in the upper orifice plate 38 and past the slot 66 in the dynamic exit plate 64 which forms a portion of the exit port 70. The exit port 70 is large enough that the sheet material 48 is able to pass through the port 70 without being constricted; a constricted exit port 70 would cause undesirable dispensing failures.

As illustrated in FIGS. 8-9 and 15-16, the sheet material 48 follows a generally Z-shaped dispensing path 77 as it flows through the slots 43, 66 of the upper orifice plate 38 and the dynamic exit plate 64, respectively. This type of circuitous path results in a frictional resistance of the sheet material 48 caused by the configuration of the dispensing path 77, and the resistance of the sheet material 48 against the slot edges 81, 80 of the slots 43, 66. Frictional resistance is also created by selection of the size and shape of the slot 43 of the upper orifice plate 38. These characteristics cooperate to provide dispensing of a proper amount of sheet material, i.e., one sheet material at a time, thereby avoiding excessive dispensing or under dispensing of sheet material.

The concave portion of the slot 66 of the dynamic exit plate 64 is positioned generally facing the concave portion of the slot 43 of the upper orifice plate 38 and is positioned behind the slot 43 of the upper orifice plate 38 when the dispenser 10 is in its closed, neutral dispensing configuration, as illustrated in FIGS. 6, 8, 14, 15 and 17. The vertical dispensing axis 78 extends vertically through the exit port 70 and represents the desired direction along which the sheet material 48 is to be dispensed.

Additionally, a first axis 72 extends vertically through the slot 43 of the upper orifice plate 38. A second axis 74 extends vertically through the slot 66 of the dynamic exit plate 64, and is spaced-apart from, and parallel to, the first axis 72. Both the first and second axis 72, 74 are also generally parallel to the vertical dispensing axis 78 when the dynamic exit plate assembly 90, 190, 290 is in a neutral configuration (see FIGS. 6, 8, 14, and 15). An oblique third axis 76 extends through both slot 43 of the upper orifice plate 38 and slot 66 of the dynamic exit plate 64, intersecting both the first axis 72 and the second axis 74.

Figure 8:
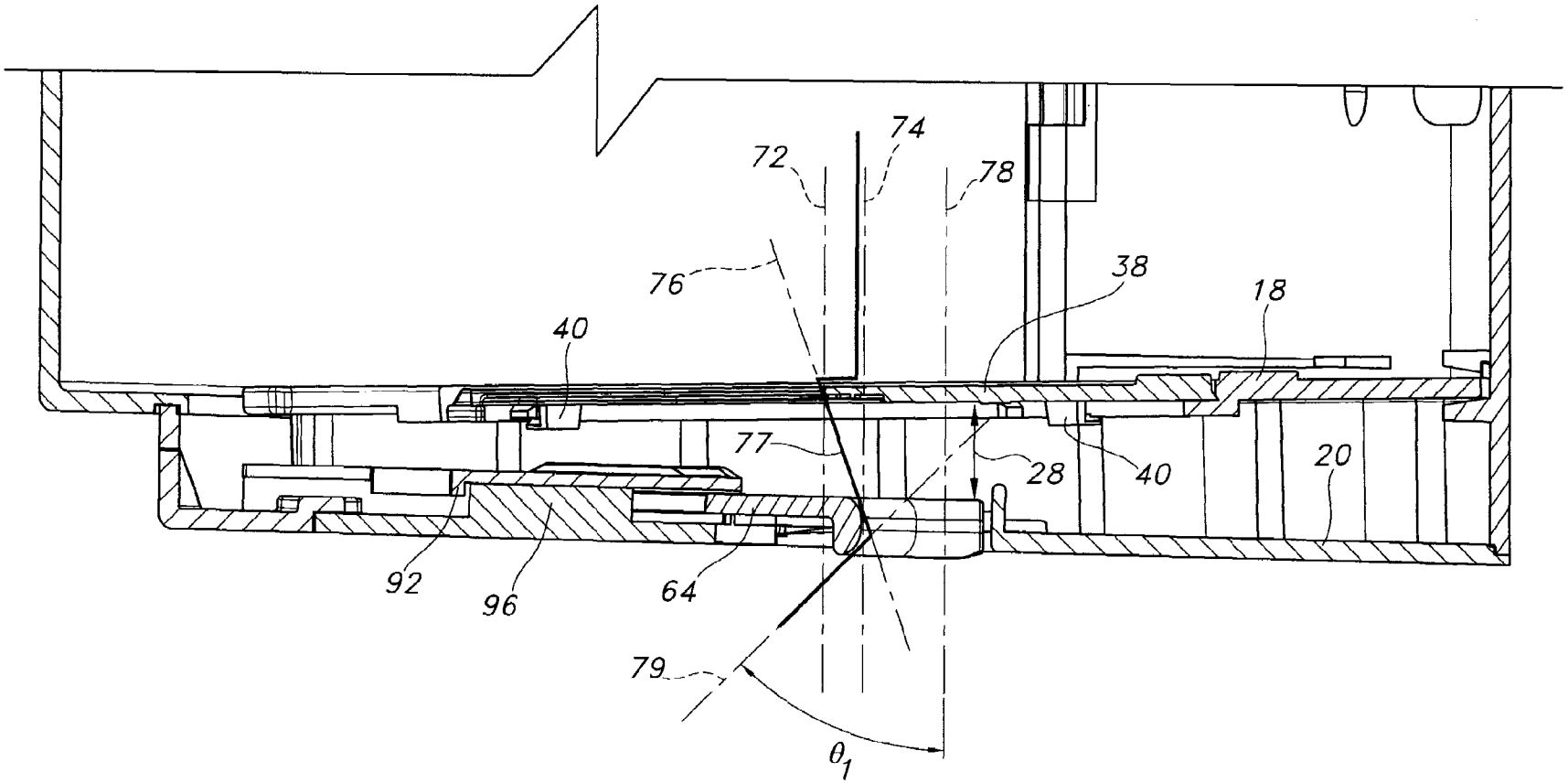
FIG. 8 is a partial, cross-sectional view of the lower portion of the dispenser of FIG. 1 and illustrating the dynamic exit plate assembly in a neutral dispensing configuration.

When the user dispenses the sheet material 48 in the most desired manner, namely straight down from the exit port 70 along the vertical dispensing axis 78, the dynamic exit plate assembly 90, 190, 290 will generally remain in the neutral configuration. However, as discussed above, users often do not dispense the sheet material 48 from such dispensers 10 in the desired vertical direction. Instead, users will dispense the sheet material at some angle to the vertical dispensing axis 78, when they pull the sheet material downward and forward or downward and toward the side of the dispenser 10. Such a deflection angle $\theta_1$ is illustrated in FIGS. 8 and 15 as the angle between the vertical dispensing axis 78 and an user dispensing axis 79. The user dispensing axis 79 represents the general direction in which the user is pulling the leading edge 82 of the sheet material 78.

It should be noted that the deflection angle is measured and described relative to the vertical dispensing axis 78 in three-dimensional space; the deflection angle may have a vertical component (i.e., some angle from straight down) and a horizontal component (i.e., some angle to the left or right of directly in front of the dispenser). The deflection angle $\theta_1$ discussed herein is generally the vertical component of dispensing. The horizontal deflection is addressed, to a large extent, by the curvature of the slot 66 of the dynamic exit plate 64.

In traditional vertical-dispensing dispensers, such a deflection angle $\theta_1$ places a great amount of stress at the point the sheet material 78 contacts the edge of the exit port and subsequently causes the sheet material 78 to tear or otherwise fail to properly dispense. However, the dynamic exit plate 64 of the present invention is adapted to reposition itself to reduce such stresses in the sheet material 78. This allows for a greater percentage of successful sheet material dispensing events even when the user dispenses at a deflection angle $\theta_1$.

FIGS. 8, 9, 15 and 16 illustrate the dispenser 10 as the user dispenses the sheet material 78 along a user dispensing axis 79 that is at some deflection angle $\theta_1$ to vertical. In that dispensing moment, the sheet material 78 engages the dynamic exit plate assembly 90, 190, 290 and the sheet material 78 applies a force upon the edge 80 of the dynamic exit plate 64. The applied force causes the dynamic exit plate 64 to reposition such that the deflection angle $\theta_1$ is effectively decreased to a reduced deflection angle $\theta_2$, relative to the vertical dispensing axis 78 (see FIGS. 9 and 16). By decreasing the deflection angle $\theta_1$ in the neutral configuration to the reduced deflection angle $\theta_2$ in the engaged configuration, the stresses on the sheet material 78 are reduced, and the probability of successful dispensing are greatly improved.

Figure 5:
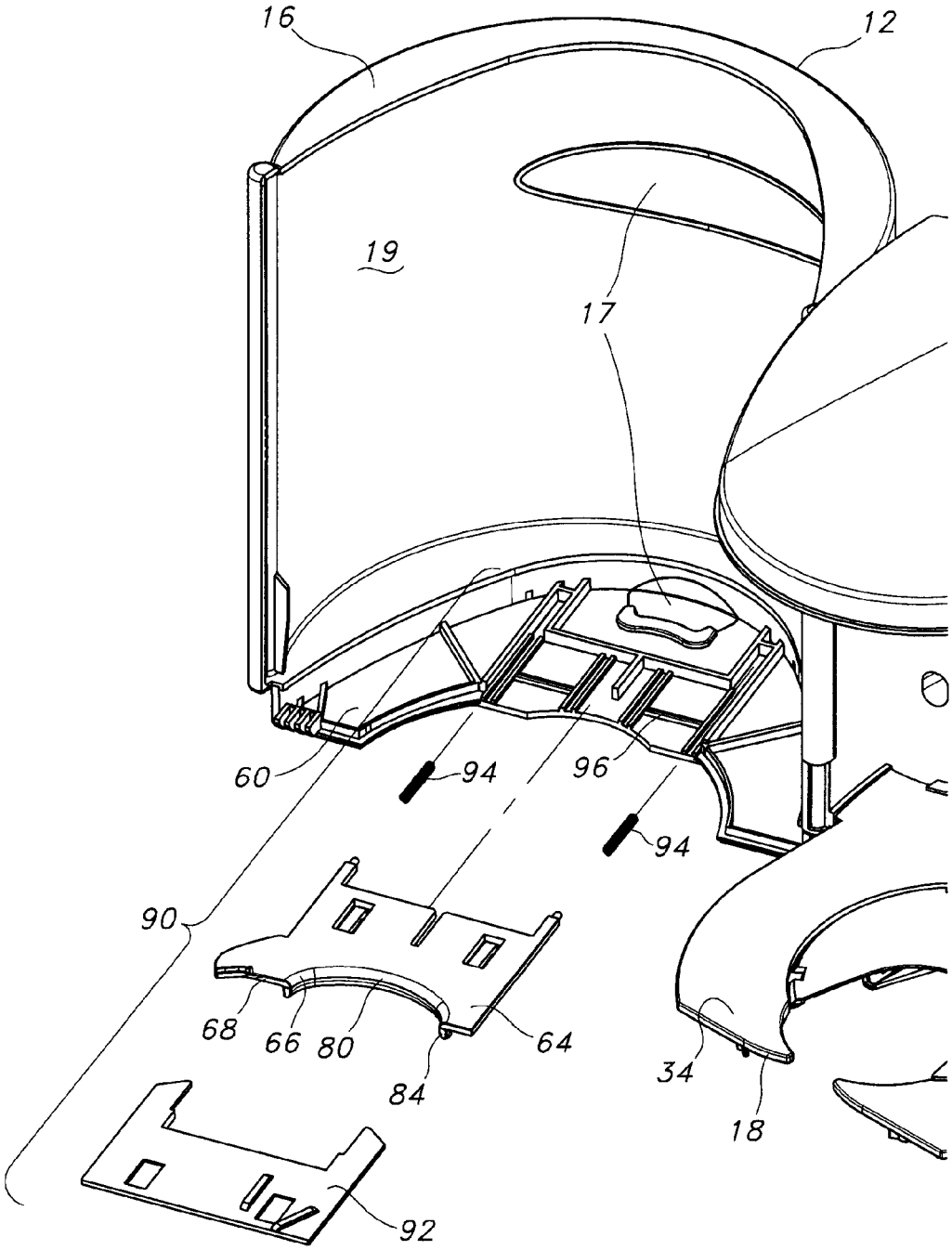
FIG. 5 is a partial exploded view of the dynamic exit plate assembly for the dispenser illustrated in FIGS. 1 to 4.
Figure 9:
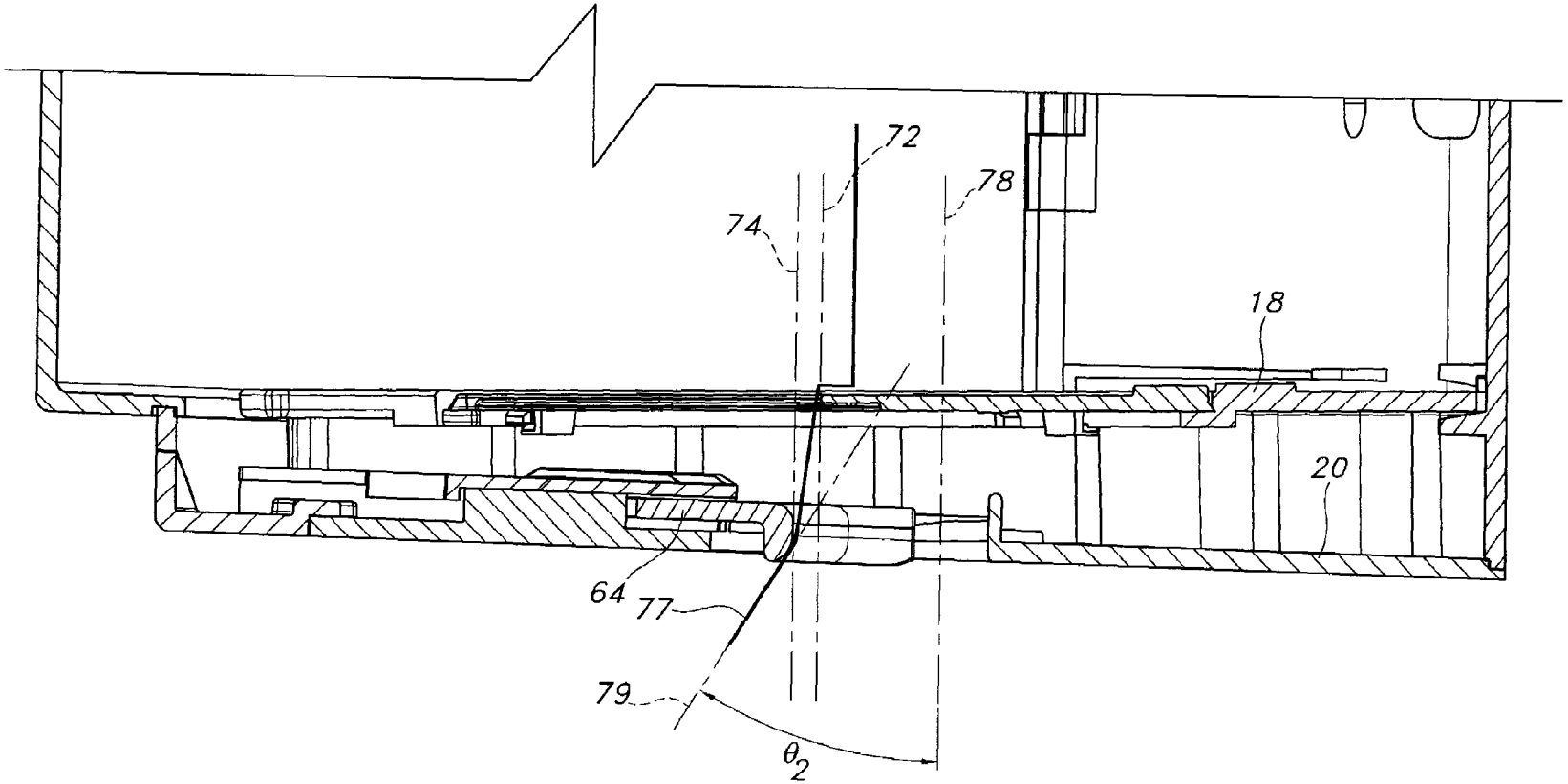
FIG. 9 is a partial, cross-sectional view, similar to FIG. 8, of the lower portion of the dispenser of FIG. 1 and illustrating the dynamic exit plate assembly in a fully-engaged configuration.
Figure 13:
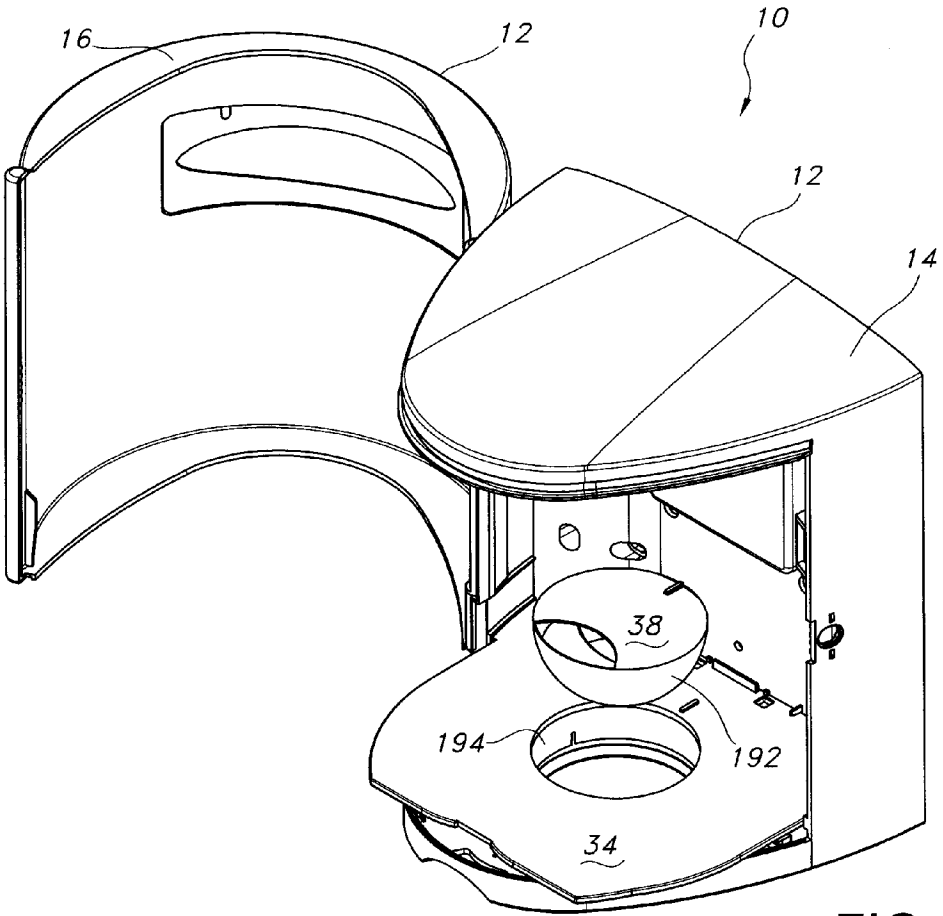
FIG. 13 is a perspective view of a dispenser for sheet material, very similar to that of FIG. 1, and illustrating a dynamic exit plate assembly with a ball-and-socket configuration, shown in a partially exploded view.

Such repositioning of the dynamic exit plate 64 may be accomplished through various configurations of the dynamic exit plate assembly 90, 190, 290. The dynamic exit plate assembly 90 configuration illustrated in FIGS. 1 to 9, is made of the dynamic exit plate 64 and a biasing means 94, which keeps the dynamic exit plate 64 biased to a neutral configuration (as illustrated in FIGS. 1, 2, 3, 4, 6 and 8). The dynamic exit plate 64 and biasing means 94 are held in place by a stop plate 96 and mated cover plate 92 (see FIG. 5). The stop plate 96 is adapted to be mated with cover plate 92 to retain the dynamic exit plate 64 and the biasing means 94, while allowing the dynamic exit plate 64 to move along the plane of the dynamic exit plate 64 between a neutral configuration (FIGS. 6 and 8) and a fully-engaged configuration (FIGS. 7 and 9). As shown in FIG. 5, the stop plate 96 may be ridges and troughs integrally formed into the lower end portion 60 of the cover 16. Alternatively, the stop plate 96 may be a separate part that is attached to the cover 16.

Figure 6:
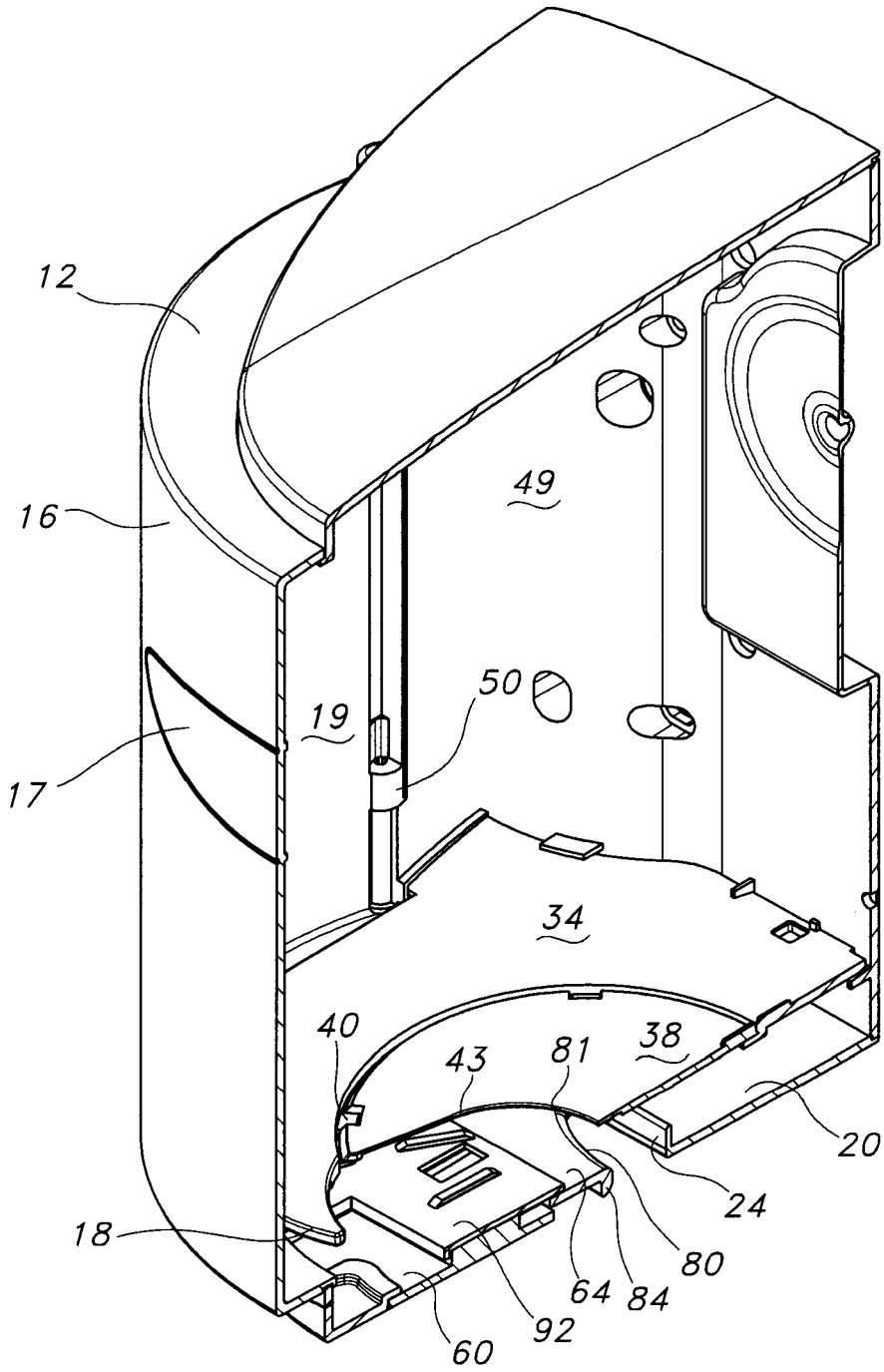
FIG. 6 is a cross-sectional, perspective view of the dispenser of FIG. 1 taken along lines 6-6 and illustrating the dynamic exit plate assembly in a neutral dispensing configuration.
Figure 7:
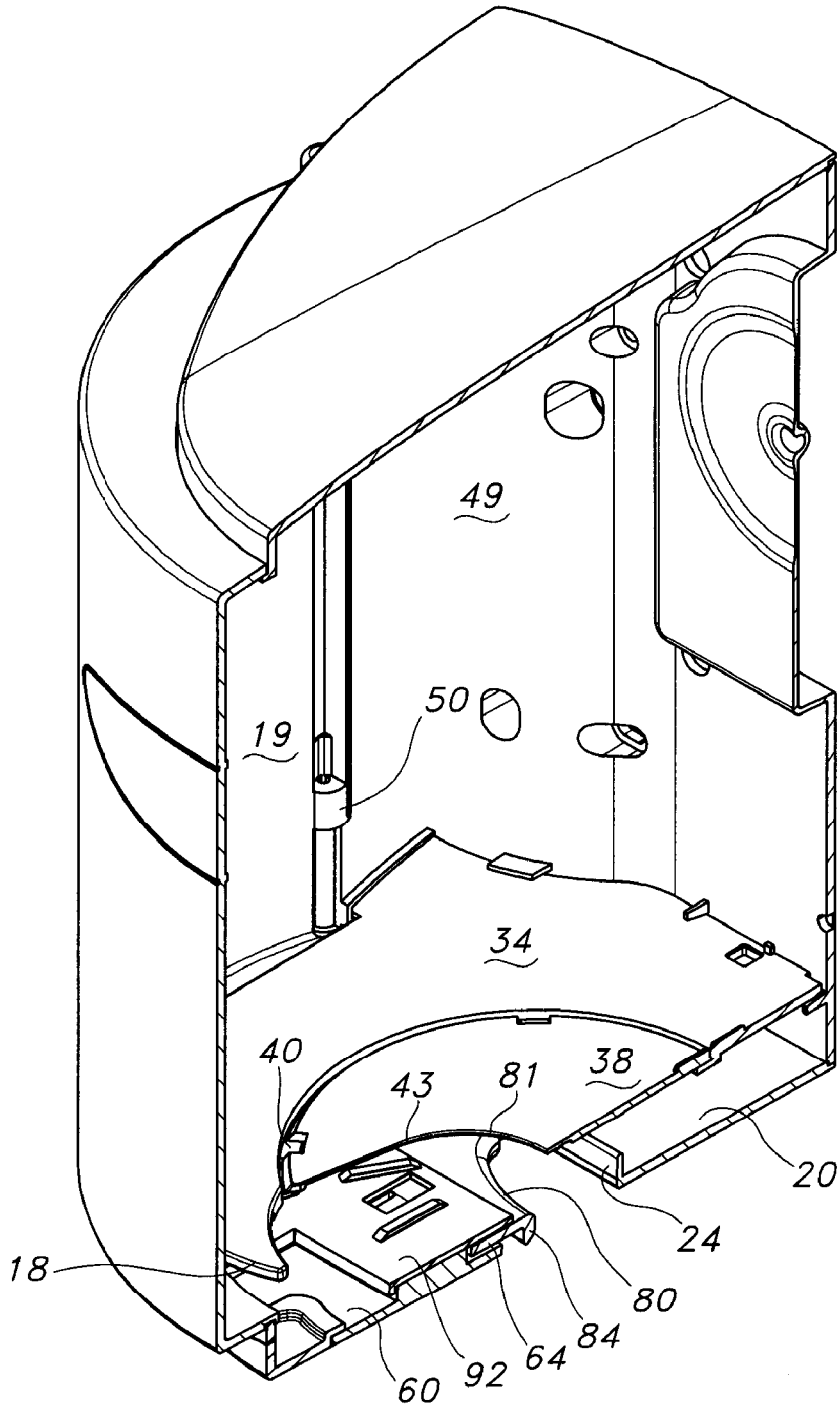
FIG. 7 is a cross-sectional, perspective view, similar to FIG. 6, of the dispenser of FIG. 1 taken along lines 6-6 and illustrating the dynamic exit plate assembly in a fully-engaged dispensing configuration.

In the configuration illustrated in FIGS. 1-9, the dynamic exit plate assembly 90 is adapted to allow the dynamic exit plate to reposition along the direction of the plane of the dynamic exit plate 64. The neutral configuration of the dynamic exit plate assembly 90 is illustrated in FIGS. 6 and 8. When the sheet material 48 is dispensed by the user at a deflection angle $\theta_1$ relative to the vertical dispensing axis 78, along a user dispensing axis 79, the sheet material 48 will apply forces to the curved edge 80 of the dynamic exit plate 64. These forces applied by the sheet material 48 press the dynamic exit plate 64 against the biasing means 94 and reposition the dynamic exit plate assembly 90 into an engaged configuration, such as illustrated in FIGS. 7 and 9. As seen in FIGS. 8 and 9, the deflection angle $\theta_1$ is decreased to the reduced deflection angle $\theta_2$ as the second axis 74 moves to the left (from the neutral configuration illustrated in FIG. 8 to the engaged configuration illustrated in FIG. 9) with the movement of the dynamic exit plate 64. As the user continues to pull toward the same point, the user dispensing axis 79 will effectively pivot on the edge 80 of the plate 64, and the deflection angle $\theta_1$ is decreased to the reduced deflection angle $\theta_2$.

As seen in FIGS. 8 and 9, the dispensing path 77 of the sheet material 48 around the edge 80 in the engaged configuration of FIG. 9 is less severe than it was prior to the repositioning of the dynamic exit plate 64 (FIG. 8). Thus, the decrease of the deflection angle relative to the vertical dispensing axis will greatly increase the probability of successful dispensing of the sheet material 48.

In some embodiments, such as discussed above, the dynamic exit plate assembly 90, 190, 290 may include a biasing means 94 that is adapted to return the dynamic exit plate 64 to the neutral configuration after being engaged by forces applied by sheet material 84 being dispensed by the user at an deflection angle $\theta_1$. Such biasing means, by way of non-limiting examples, may include a helical spring (tension or compression spring), a leaf spring, a V-spring, a torsion spring, a gas spring, an elastic band or cord, or the like. Any mechanical or structural part or configuration that allows the dynamic exit plate 64 to be repositioned when force is applied by the sheet material 48 to the dynamic exit plate 64, while biasing the plate 64 to the neutral configuration when such a force is not being applied, may be utilized as the biasing means 94.

The biasing means 94 used in the planar configuration of the dynamic exit plate assembly 90 illustrated in FIGS. 1-9 is desirably a helical compression spring, although other biasing means could be used. One skilled in the art could see how the particular biasing means 94 used would be designed to accommodate the particular sheet material 48 to be dispensed. The strength of the biasing means 94 would need to be such that the dynamic exit plate 64 will reposition when the sheet material 48 applies a force on the plate 64 when the user dispenses the sheet at a deflection angle from vertical. Additionally, the biasing means 94 and the size of the exit port 70 must be designed such that the dynamic exit plate 38 does not exert any compressive force on the sheet material 48 when the dynamic exit plate assembly 90 is in its neutral configuration and that the sheet 48 is not unduly constricted when passing through the exit port 70. Such compressive forces or other constriction of the sheet 48 within the exit port 70 may cause undesirable dispensing failures.

In another configuration, the dynamic exit plate assembly 190 may be in a ball-and-socket configuration such as illustrated in FIGS. 13 to 16. In such a configuration, a hemispherical ball assembly 192 may include both the upper orifice plate 38 and the dynamic exit plate 64. As with the configuration discussed above, the upper orifice plate 38 may be adapted to be removable from the ball assembly 192. The ball assembly 192 would be adapted to fit within a socket 194 within the dispenser housing 12 of the dispenser 10. The socket 194 may be formed within roll platform 18, formed within the lower end 20, or may be a separate part otherwise attached to the dispenser housing 12. The socket 194 would be adapted to accept and retain the ball assembly 192, while allowing the ball assembly 192 to freely move within the socket 194. The materials used for both the ball assembly 192 and the socket 194 would be those known to allow such freedom of movement. The movement of the ball assembly 192 within the socket 194 may additionally be aided by the use of a lubricant or other form of bearings, as are well known.

In the neutral configuration, illustrated in FIGS. 14 and 15, the dispensing of the sheet material 48 would be very similar to the neutral configuration of the planar dynamic exit plate assembly 90 illustrated in FIGS. 6 and 8. Namely, the first and second axis 72, 74 are parallel to each other and parallel to the vertical dispensing axis 78.

When the sheet material 48 is dispensed by the user along the user dispensing axis 79 at a deflection angle $\theta_1$ relative to the vertical dispensing axis 78, the sheet material 48 will apply forces to the edge 80 of the dynamic exit plate 64. These forces applied by the sheet material 48 on the dynamic exit plate 64 will cause the dynamic exit plate assembly 190 to reposition into an engaged configuration, such as illustrated in FIG. 16. In the ball-and-socket configuration of the dynamic exit plate assembly 190, the ball assembly 192 would pivot in the socket 194 to effectively decrease the deflection angle.

As seen in FIGS. 15 and 16, the deflection angle $\theta_1$ would again be decreased to the reduced deflection angle $\theta_2$ by the movement of second axis 74. Rather than the second axis 74 moving back and forth, as in the planar configuration of the dynamic exit plate assembly 90 illustrated in FIGS. 1-9, the second axis 74 would pivot with the ball assembly 92, as the sheet material 48 applies forces on the dynamic exit plate 64. As the second axis 74 pivots (from the neutral configuration illustrated in FIG. 15 to the engaged configuration illustrated in FIG. 16) with the movement of the dynamic exit plate 64, the user dispensing axis 79 would effectively pivot, moving with the edge 80 of the plate 64, and cause the deflection angle $\theta_1$ to decrease to the reduced deflection angle $\theta_2$.

Figure 17:
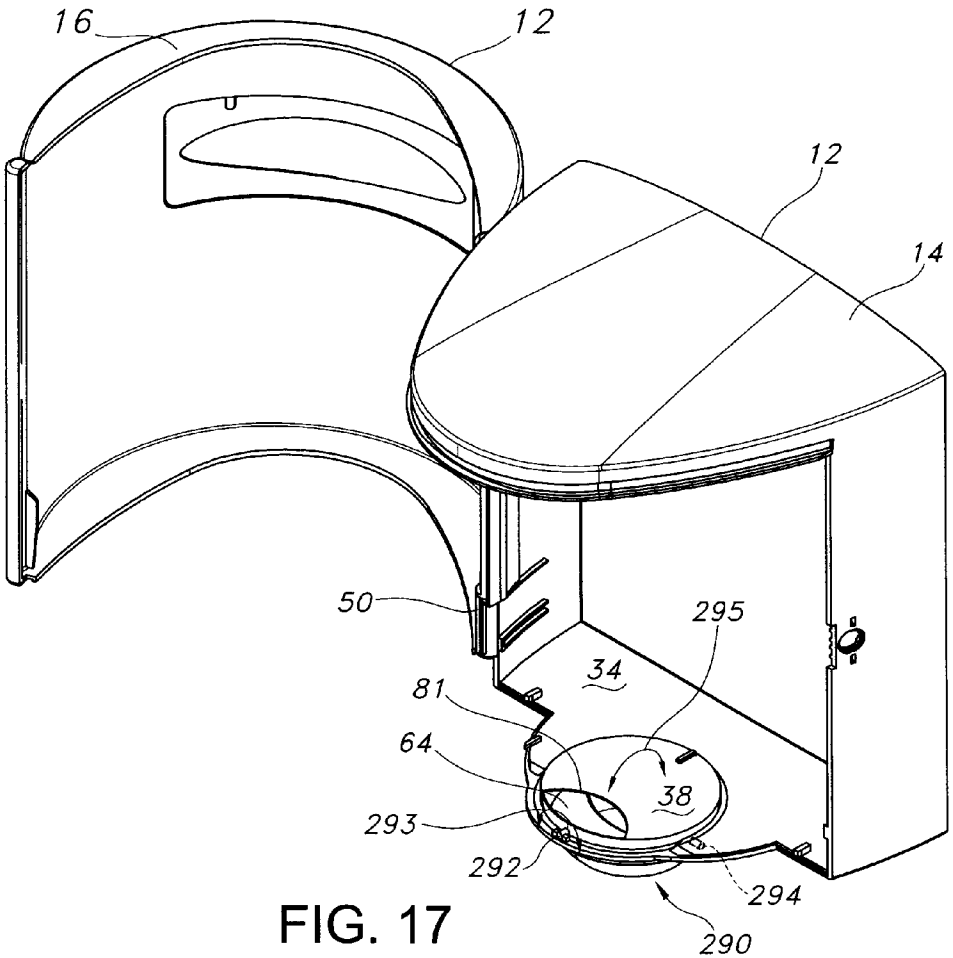
FIG. 17 is a perspective view of a dispenser for sheet material, very similar to that of FIG. 1 and FIG. 13, and illustrating a dynamic exit plate assembly with a gimbal configuration.

In another configuration, the dynamic exit plate assembly 290 may be in a gimbal configuration, such as illustrated in FIG. 17. Such a configuration would operate similarly to the ball-and-socket configuration discussed above. As shown in FIG. 17, an inner ring may include the upper orifice plate 38 and dynamic exit plate 64 in a orientation similar to the ball assembly 192 illustrated in FIGS. 13-16. The inner ring could then be attached to an outer ring by a pair of longitudinal axle pins 292. The outer ring could then be attached to the roll platform 18 by a pair of lateral axle pins 294. In this manner, the dynamic exit plate assembly 290 would be able to simultaneously be adapted to rotate or roll 293 about the longitudinal axle pins 292 and rotate or pitch 295 about the lateral axle pins 294. In alternative embodiments, the longitudinal and lateral axle pins 292, 294 may be switched (i.e., the inner ring could be attached to the outer ring by the lateral axle pins 294).

As discussed above for the ball-and-socket configuration, the gimbal configuration of the dynamic exit plate assembly 290 would allow the dynamic exit plate 64 to reposition when sheet material 48 is dispensed at a deflection angle to a vertical dispensing axis 78. The dynamic exit plate assembly 290 would pitch 295 and/or roll 293 to decrease the deflection angle and thus increase the probability of successful dispensing, as discussed in detail above.

In an exemplary method of use of installing a sheet material 48, a dispenser 10 having an exit port 70 is provided. An operator opens the dispenser housing 12 by releasing the cover 16 and moves the cover 16 away from the roll housing 14 so that the roll platform 18 may be accessed. The roll platform 18 includes an upper orifice plate 38 having a slot 43 therein, in which the upper orifice plate 38 including the configuration of the slot 43 is selected by the operator in order to dispense an effective number of sheet material 48 through the slot 43 and the exit port 70. The centerflow roll 58 of sheet material 48 is disposed on the roll platform 18, and a leading edge 82 of the sheet material 48 is threaded through the slot 43 in the upper orifice plate 38; the leading edge 82 is positioned to extended a distance therefrom. The cover 16 of the dispenser housing 12 is then closed, and the leading edge 82 of the sheet material 48 extends from the exit port 70.

In a method of adjusting sheet material 48 flow from a dispenser 10, a dispenser housing 12 is provided which includes a roll platform 18 to support sheet material 48 thereon. The dispenser housing 12 also has an exit port 70. The roll platform 18 may be configured to hold a removable upper orifice plate 38 having a slot 43 formed therein. The upper orifice plate 38 is selected in accordance with the sheet material product type, and inserted into the roll platform 18. Sheet material 48 is then loaded onto the roll platform 18 and a leading edge 82 is threaded through the slot 43 in the upper orifice plate 38; a leading edge 82 of the sheet material 48 is extended a distance therefrom. The dispenser housing 12 is closed, and the leading edge 82 extends from the exit port 70.

The dispenser 10 is configured to permit a user to open the dispenser housing 12, select an orifice plate, for example, 38 or 38', and position the selected orifice plate 38 or 38' in the opening 22 of the roll platform 18, while using only one hand. In addition, the dispenser 10 is configured to permit a user to dispose a new centerflow roll 58 of sheet material 48 in the dispenser 10, thread the leading edge 82 of the sheet material 48 through the slot 43 or 43' in the orifice plate 38 or 38' and to close the dispenser housing 12, while using only one hand.

EXAMPLE

The dispenser of the present invention was comparatively tested against a commercial centerflow roll dispenser. The comparative dispenser used for the dispensing testing was an IN-SIGHT® Roll Control Center-Pull Towel Dispenser (Product Code 09989) as available from Kimberly-Clark Professional, Roswell, Ga. The dispenser of the present invention was a commercial dispenser modified to include a dynamic plate assembly 90, as illustrated in FIGS. 1-9.

For the dispensing test protocol, each dispenser was mounted on a wall with the dispenser's dispensing port located 56 inches (1.42 m) above the floor. The sheet material dispensed from the dispensers was SCOTT® Roll Control Center-Pull Towels (Product Code 01032), available from Kimberly-Clark Professional, Roswell, Ga. Each dispenser was tested by dispensing the sheet material at three different deflection angles: vertical (0-degree deflection angle), 45-degree deflection angle from vertical, and 60-degree deflection angle from vertical. Each dispensing angle, for each dispenser, was tested by six different testers with each tester dispensing all of the sheets of the roll product (approximately 700 sheets per roll).

Each roll was dispensed by the tester in a uniform fashion. The tester used a single hand to dispense the sheet material. Between the dispensing of each sheet, the tester would dip the fingertips of their dispensing hand into a tub of water. A steady pace is maintained by the tester for each dispensing motion. For each dispensing angle, for each tester, half of the rolls were tested at a medium dispensing rate (80 beats per minute, by metronome) and half of the rolls were tested at a fast dispensing rate (104 bpm). Dispensing defects were recorded during dispensing testing as they occurred. Recordable dispensing defects included:

Tab: When a tab or piece of towel [>1.5" by 1.5" (38.0 mm by 38.0 mm)] is pulled off the main body of the towel where it is grasped. It may sometimes remain attached to the body of the towel by a very small amount.

Tear: A rip in the towel [>1.5" long (38.0 mm)] that occurs at any location in the towel other than where it is grasped.

Hole: When the towel is torn [>0.5 in. diameter (13.0 mm)] but the towel does not tear completely to remove the piece of towel. It may sometimes occur when the finger or thumb goes through the towel.

Perf Tear: A rip in the towel [>1.5" (38.0 mm) from center point of failure to corner of dispensed sheet that occurs only at the perforation point.

Roll Collapse: When the roll looses its shape. When this happens the tester will remove the roll and count the number of sheets involved in this occurrence and record the number on the data sheet.

Open Cabinet: When a jam or other problem necessitates opening the cabinet to make the needed correction.

Ply Delamination: While dispensing the laminated sheets separate.

Roping: When 1 or more connected towels come out of the dispenser with one pull. Tester counts the sheet in hand in the occurrence.

No Tail: When the towel breaks inside of the dispenser.

Short Tail: When the exposed towel is [<0.5" (13.0 mm) in length from the bottom of the dispenser and the tester has difficulty grasping the towel to dispense.

2 Sheets Attached: When 2 attached towels are dispensed with one pull. This difference between 2 sheets and roping is the towel tears easily at the perforations. With roping there is a feeling more towels would have been dispensed, however, due to the angle of the pull (towards tester) will not allow any more towels to be dispensed.

2 Sheets Unattached: When 2 unattached towels come out of the dispenser together with one pull.

Streaming: When one or more towels come out of the dispenser with one pull and the sheet which is held breaks off at the perforations.

Other: Any undefined defect.

The results of the testing of both the dispenser of the present invention and the commercial comparison dispenser are given below in Table 1. The results are reported as the percentage of dispensing defects (i.e., number of dispensing defects versus the total number of sheets dispensed) for each dispenser, at each dispensing angle. A lower percentage of dispensing defects is desired.

TABLE 1

| | 0-degree dispensing | 45-degree dispensing | 60-degree dispensing |
|---|---|---|---|
| Commercial Dispenser | 5.5% | 47.7% | 88.5% |
| Modified Dispenser (with dynamic exit plate) | 1.4% | 4.4% | 21.7% |

As the results in Table 1 show, the use a dynamic exit plate assembly dramatically improved the ability of the dispenser to successfully dispense sheet material at increasing deflection angles relative to a vertical dispensing axis.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser adapted to dispense sheet material in a generally vertical direction, the dispenser comprising:

a housing comprising a platform, a dynamic exit plate, and a vertical dispensing axis, where the platform is configured to support sheet material thereon, where the platform comprises an opening positioned on a first axis, where the dynamic exit plate is spaced apart from the platform, where the dynamic exit plate comprises an exit port positioned on a second axis, where the second axis is parallel to the first axis and is spaced apart from the first axis, where the sheet material disposed in the dispenser flows between the opening and the exit port on a third axis, and where the dynamic exit plate is adapted to reposition when sheet material applies force on the dynamic exit plate as the sheet material is dispensed at an angle of deflection, relative to the vertical dispensing axis.

2. The dispenser of claim 1, where the platform comprises a removable orifice plate comprising the opening positioned thereon.

3. The dispenser of claim 1, where the opening forms a curved shape.

4. The dispenser of claim 1, where the exit port comprises a curved lip.

5. The dispenser of claim 1, where the sheet material follows a generally Z-shaped path from the opening and through the exit port.

6. The dispenser of claim 5, where the Z-shaped path causes frictional resistance that assists in dispensing one sheet material at a time from the dispenser.

7. The dispenser of claim 1, where the dynamic exit plate is biased to a neutral configuration.

8. The dispenser of claim 7, where the dynamic exit plate is configured to reposition in a direction perpendicular to the second axis.

9. The dispenser of claim 7, where the exit plate is configured to reposition by pivoting the dynamic exit plate and second axis relative to the vertical dispensing axis.

10. The dispenser of claim 1, where the dynamic exit plate is configured to reposition in a direction perpendicular to the second axis.

11. The dispenser of claim 1, where the dynamic exit plate is configured to reposition by pivoting the dynamic exit plate and second axis relative to the vertical dispensing axis.

12. A dispenser adapted to dispense sheet material, the dispenser comprising:

a housing comprising a platform configured to support sheet material thereon, an orifice plate, a dynamic exit plate, an exit port, and a vertical dispensing axis, where the orifice plate comprises an opening positioned thereon, where the dynamic exit plate is spaced apart from the orifice plate, where the sheet material disposed in the dispenser flows between the opening and the exit port in a generally Z-shaped path, and where the dynamic exit plate is adapted to reposition when sheet material applies force on the dynamic exit plate as the sheet material is dispensed at an angle of deflection, relative to vertical dispensing axis.

13. The dispenser of claim 12, where the orifice plate is removable.

14. The dispenser of claim 12, where the dynamic exit plate comprises a biasing means and a curved lip positioned on the dynamic exit plate, where the dynamic exit plate is configured to slide back and forth on a plane generally perpendicular to the vertical dispensing axis, and where the biasing means is configured to return the dynamic exit plate to a neutral position after force being applied by sheet material being dispensed at an angle of deflection has been removed.

15. The dispenser of claim 12, further comprising a socket assembly, the socket assembly comprising a pocket and a hemispherical structure seated within the pocket, where the hemispherical structure comprises the orifice plate and the dynamic exit plate, and where the hemispherical structure is configured to pivot within the pocket.

16. The dispenser of claim 15, where the socket assembly further comprises a biasing means the returns the hemispherical structure to a neutral position after force being applied by sheet material being dispensed at an angle of deflection has been removed.

17. The dispenser of claim 12, further comprising a gimbal assembly, the gimbal assembly comprising an outer ring, a middle ring, and an inner ring, where the inner ring comprises the orifice plate and the dynamic exit plate, and where the rings are allowed to rotate relative to each other.

18. The dispenser of claim 17, where the gimbal assembly further comprises a biasing means the returns the gimbal structure to a neutral position after force being applied by sheet material being dispensed at an angle of deflection has been removed.

19. A dispenser adapted to dispense sheet material, the dispenser comprising:

a housing comprising a platform, a dispensing port, and a vertical dispensing axis, where the platform is configured to support sheet material thereon; and means for controlling the movement of sheet material disposed in the housing through the dispensing port and reconfiguring the dispensing port to accommodate dispensing of sheet material at an angle of deflection relative to the vertical dispensing axis, where the controlling means comprises an opening positioned on a first axis and a moveable exit port positioned on a second axis.

20. The dispenser of claim 19, where the sheet material moving from the housing and through the exit port follows a circuitous path which causes frictional resistance and assists in dispensing one sheet material at a time from the dispenser.

* * * * *